United States Patent [19]

Greene

[11] Patent Number: 4,648,583

[45] Date of Patent: Mar. 10, 1987

[54] WHEEL LIFTING KIT FOR BUMPER JACKS

[76] Inventor: William G. Greene, 28 Scott Rd., West Brome, Quebec J0E 2P0, Canada

[21] Appl. No.: 750,230

[22] Filed: Jun. 28, 1985

Related U.S. Application Data

[63] Continuation of Ser. No. 582,090, Feb. 21, 1984, abandoned.

[30] Foreign Application Priority Data

Nov. 4, 1983 [CA] Canada ..... 440498

[51] Int. Cl.[4] ..... B66F 3/00

[52] U.S. Cl. ..... 254/133 R; 294/904

[58] Field of Search ..... 254/1, 108, 133, 134; 294/82 AH; 414/426, 427

[56] References Cited

U.S. PATENT DOCUMENTS 3,154,206 11/1964 Gillette, Jr. et al. ..... 414/426

FOREIGN PATENT DOCUMENTS 305816 10/1952 Switzerland ..... 254/133 R

*Primary Examiner*—Roscoe V. Parker
*Assistant Examiner*—Judy J. Hartman

[57] ABSTRACT

A lifting bracket kit for a vehicle wheel on a vehicle connects with a bumper jack or body jack supplied with the vehicle or other type of lifting device so the vehicle can be raised by the wheel for maintenance and other purposes. Avoids spring extension and allows vehicle to be placed on blocks. The bracket has a support loop with a first element having an elongate portion adapted to extend across the back of the vehicle wheel below the wheel axis of rotation, the first element having curved portions at each end adapted to pass up and around to the front of a tire on the vehicle wheel; a second element adapted to extend across the front of the vehicle wheel at an elevation above the elongate portion of the first element; two hooks for joining the ends of the first element and the second element together to form the loop and two flexible link members extending from the two hooks connecting to a single lifting connector adapted to be positioned above the wheel axis of rotation, the lifting connector having an attachment for an external lifting device.

1 Claim, 6 Drawing Figures

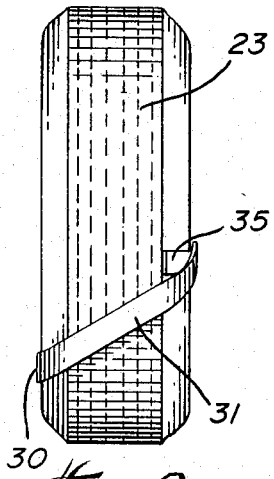
Fig. 3
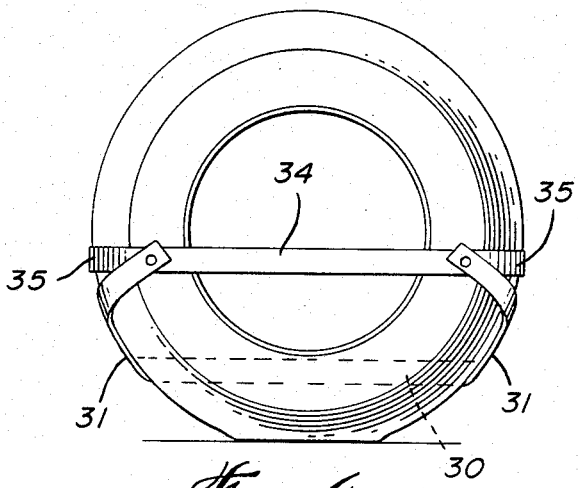
Fig. 4
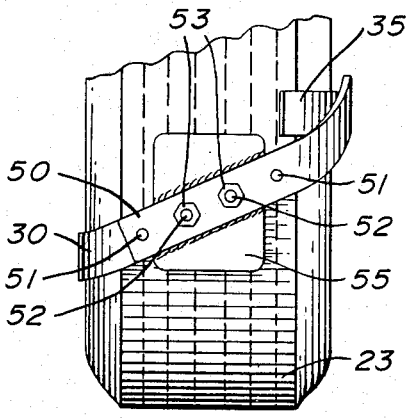
Fig. 5
Fig. 6
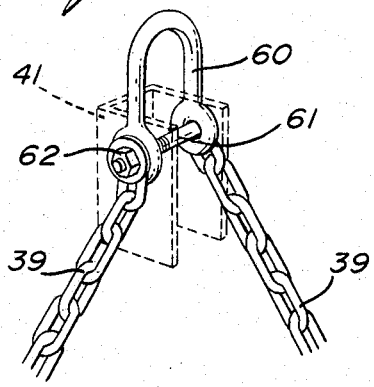

WHEEL LIFTING KIT FOR BUMPER JACKS

This application is a continuation of application Ser. No. 582,090, filed Feb. 21, 1984, now abandoned, The present invention relates to jacking up vehicles for maintenance and other purposes. More specifically, the present invention relates to a lifting bracket supplied in kit form for supporting a vehicle wheel on a vehicle which may be used for lifting the vehicle with a standard bumper jack or other lifting device.

Bumper jacks or body jacks are provided with nearly all motor vehicles for changing a wheel. These jacks, however, are designed to raise the body of the vehicle and the wheel only leaves the ground after the jack has extended the springs and shock absorbers on the vehicle to their limit. Most bumper jacks are designed for changing a wheel and thus it is only necessary to have a small clearance between the wheel and the ground at the time of changing the wheel. Most body jacks or bumper jacks used for raising the body of a vehicle provide only about 5 centimetres of clearance under an inflated tire.

Ramps are somtimes used to provide under vehicle access without the use of sophisticated vehicle lift equipment. This is not always convenient or safe as the vehicle has to be driven onto the ramp and the torque in the case of the drive wheels may upset the ramp arrangement.

The present invention provides a lifting bracket kit which supports a vehicle wheel and allows a vehicle to be raised by means of a jack supplied with the vehicle to provide a clearance under the wheel of from 15 to 20 centimetres which is sufficient for a standard concrete building block to be placed under the wheel. The wheel may then be lowered to rest on the concrete block as the jack is lowered. This action can take place on both ends of the vehicle for front and back wheels so the whole vehicle is raised up on blocks and if further height is needed, another block can be placed beside a first block and the jack supported on the other block so the wheel can be raised to double the height of the first block thus allowing easy access under a vehicle.

The present invention provides a lifting bracket for supporting a vehicle wheel on a vehicle with an attachment means for an external lifting device, the lifting bracket comprising: a support loop with a first element having an elongate portion adapted to extend across the back of the vehicle wheel below the wheel axis of rotation, the first element having curved portions at each end adapted to pass up and around to the front of a tire on the vehicle wheel; a second element adapted to extend across the front of the vehicle wheel at an elevation above the elongate portion of the first element; two hook means for joining the ends of the first element and the second element together to form the loop, and two flexible link members extending from the two hook means connecting to a single lifting connector adapted to be positioned above the wheel axis of rotation, the lifting connector having attachment means for an external lifting device.

In other embodiments of the invention, adjustment means may be provided in the curved portions at each end of the first element of the loop to adjust for different tread widths of tires. In another embodiment, bearing pads may be placed in the curved portions adapted to be positioned against a tire which provides a contact area with reduced loading pressure.

In one embodiment the lifting device is a bumper jack and the attachment means on the lifting connector is a jack attachment bracket. In another embodiment the lifting connector having attachment means is a shackle to be raised by the hook of a crane or other overhead lifting device.

In drawings which illustrate the embodiments of the invention:

FIG. 3 is a side elevational view of a wheel showing a portion of the lifting bracket attached;

FIG. 4 is a front elevational view of a wheel showing a portion of the lifting bracket attached;

FIG. 5 is a partial side elevational view of a wheel showing another embodiment of a lifting bracket attached;

FIG. 6 is a perspective view showing a shackle as the lifting connector for the lifting bracket.

Figure 1:
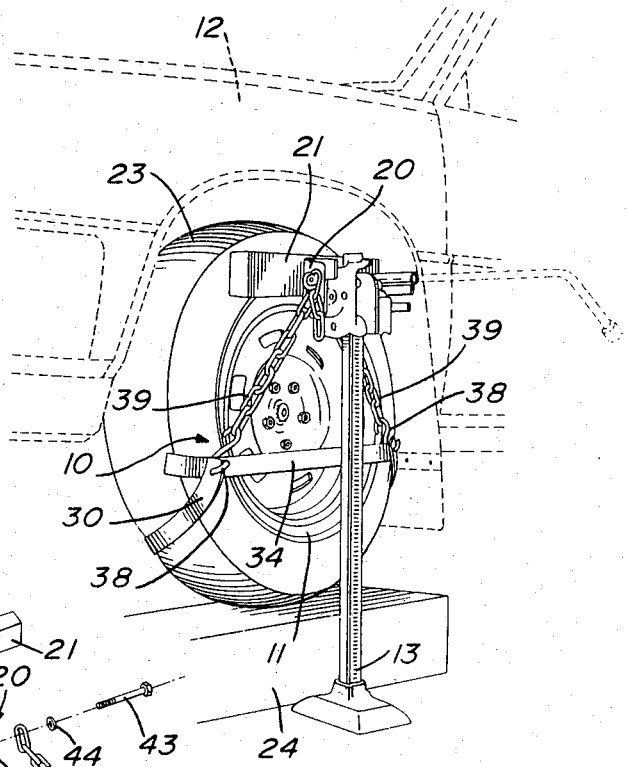
FIG. 1 is a perspective view showing one embodiment of a lifting bracket fitted to a wheel which is being raised by a bumper jack.

A lifting bracket assembly kit 10 is shown in FIG. 1 supporting a wheel 11 on a motor vehicle 12. A bumper jack 13 connects by means of a lifting lug 14 (shown in FIG. 2) to the lifting connector 20 of the lifting bracket assembly 10 for raising the wheel 11 and hence the vehicle. A spacer 21 which is generally a wooden block, is shown wedged between the lifting connector 20 and the tire 23 on the wheel 11. The spacer block 21 serves the purpose of ensuring that the stem of the bumper jack 13 is kept clear of the panel of the vehicle 12 above the wheel 11. A support block 24 which may be concrete, wood or other suitable material is shown beside the lifting jack 13 and is placed under the wheel 11 after it has been raised.

Figure 2:
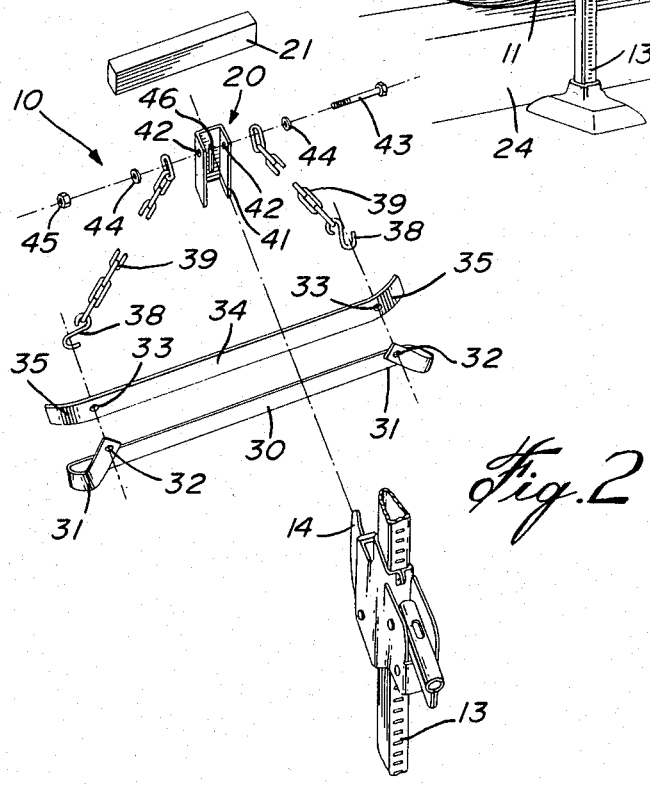
FIG. 2 is an exploded view of a lifting bracket according to one embodiment of the present invention shown with a bumper jack.

The lifting bracket assembly 10 is illustrated in detail in FIG. 2 and forms a kit for supporting a vehicle wheel. A support loop for the vehicle wheel is made up of a first band or strap element 30 with curved portions 31 at each end which are bent to fit the tread contour of a tire and thereby provide contact area between the support loop and the wheel 11. By the term "curved portions" used throughout the specification, is meant a portion that has at least one bend at each edge of the tire tread, and a substantially flat section across the tire tread. The first element 30 is preferably formed from metal and has sufficient strength to support the complete wheel 11 and vehicle 12. As can be seen more clearly in FIGS. 3 and 4, a central elongate portion of the first element 30 passes across the back of the wheel 11 well below the wheel axis of rotation. Holes 32 in the ends of the first element 30 match with holes 33 in a second band or strap element 34, also preferably formed from the metal which passes across the front of the wheel 11 at an elevation above the elongate portion of the first element 30. As can be seen, the second element 34 has slightly curved ends 35 that conform to the curved sides of the tire 23.

Two hooks 38 pass through the holes 33 in the second element 34 and holes 32 in the first element 30 to hold the second element 34 to the first element 30 and form the support loop. Two short lift chains 39 which are link members extend from each of the hooks 38 and join at the single lifting connector 20. As can be seen in FIG. 2, the lifting connector 20 comprises a U-shaped bracket 41 with two holes 42 in the flanges through which passes a bolt 43. Washers 44 with a self locking nut 45 on the end of the bolt 43 attach the ends of the chains 39 to the U-shaped bracket 41. The U-shaped bracket 41 has a slot 46 at the back thereof which provides a connection to the lifting lug 14 of a bumper jack 13. In another embodiment, the stem of bolt 43 provides a connection to a different type of lifting member on a bumper jack.

The suspended wheel is stable and does not tend to rotate because the lifting connector 20 is above the wheel axis of rotation and because the chain loads are equal and cancel each other out in their tendency to rotate the suspended wheel. The extent of side loading on the wheel 11, tire abrasion and tire deformation caused by the use of the lifting bracket 10 are frequently exceeded in normal vehicle use when cornering or angle parking against a curb.

It has been found that one size of lifting bracket kit works well over a range of wheel and tire sizes because the position of the curved portion 31 of the first element 30 adjusts to the contour of the tire when the wheel is first raised. This self adapting characteristic is an interaction of the width of the tire, the outside diameter of the tire and the flexing characteristics of the tire.

In the embodiment shown in FIG. 5, the width of the curved portion 31 of the first element 30 may be varied to take into account different widths of tire tread. The curved portion 31 of the first element 30 is formed of overlapping straps 50 with holes 51 therein and flat head machine bolts 52 counter-sunk flush into the tread contact side of the inside strap 50 and secured with nuts 53 using a selective pair of holes in each of the straps 50. Also shown in FIG. 5 is a bearing pad 55 positioned against the tire 23 and attached to the curved portion 31 of the first element 30. The bearing pad increases load distribution between the tire 23 and the curved portion 31 or inside strap 50 of the first element 30 and provides a contact area with a reduced loading pressure.

In operation the vehicle is secured against movement, the operator holds one end of the first element 30 at ground level and passes the other end behind the wheel 11 until it reappears, both ends are then brought towards the operator bringing the back of the first element 30 against the inside of the tire 23. The second element 34 is placed horizontally against the front of the wheel 11 between the tire 23 and the ends of the first element 30. The lifting connector 20 is attached to the lifting lug 14 of the jack 13. With the jack lowered and the base of the jack 13 against the tire 23 at the tire ground contact point, the operator takes the two lift chains 39, ensures that there are no twists in them, and engages the hooks 38 through the holes 33 in the second element 34 and holes 32 in the first element 30, this forms the loop supporting the wheel 11.

The operator operates the jack to take up the slack in the chains 39, and reaches behind the wheel and lifts the first element 30 as the jack is raised until the curved portions 31 are snug in place around the tire 23. The operator then places the spacer block 21 between the lifting connector 20 and the outside face at the top of the tire 23 to ensure that the jack stem remains vertical and does not interfere with the body parts. The wheel lifting operation may then be carried out.

After raising a vehicle wheel to the desired height, a block 24 which may be concrete or wood can be placed under the wheel 11 and by lowering the jack 13, the wheel 11 is brought to rest on the block 24. The jack 13 is lowered, the hooks 38 are unhooked from the first element 30 and second element 34 and the operation may be repeated on another wheel of the vehicle 12. After a pair of wheels have been raised, a further block may be brought up and placed beside the block 24 under the wheel 11 and the jack 13 is then used to raise the wheel 11 up further.

FIG. 6 illustrates the lifting connector 20 shown in FIGS. 1 and 2, which is for attachment to a jack 13, being replaced by a shackle 60 having a bolt 61 and nut 62 to support the lift chains 39. The shackle 60 may be used with a crane hook, or other type of hoist hook for raising the wheel 11 of the vehicle 12.

Whereas a bumper jack has been the only type of jack illustrated herein, it will be understood that this bumper jack may be replaced by a body jack or any suitable lifting mechanism with the lifting connector 20 modified or adapted in the necessary manner.

Various changes may be made to the embodiments shown herein without departing from the scope of the present invention which is limited only by the following claims.

The embodiments of an invention in which an exclusive property or privilege is claimed are defined as follows:

1. A rigid closed-loop metal-strap bracket adapted to be suspended from two hook means depending from two flexible link lift members, said lift members extending upwards to a single lifting connector for lifting a vehicle by a wheel-and-inflated-tire portion thereof using external lifting means, said closed-loop bracket comprising two rigid metal-strap elements, a first strap element having an elongate central portion substantially horizontal adapted to straddle strap-like between inboard-most surfaces of a wheel-and-inflated-tire portion of a vehicle, at a distance substantially the radius of said wheel, below the rotation axis of said wheel and tire, said first element adapted symmetrically from said horizontal elongate portion towards the extremeties of said first element to curve upwards strap-like against said tire towards and to outboard surfaces thereof, whence extremeties of said first element project in symmetrically convergent directions substantially towards a point on the outboard-most surface of said tire, said point vertically above the rotation axis of said wheel and tire, and said extremeties terminating at an upper edge of, and outboard of, and overlapping a second strap element; said second strap element substantially horizontal adjacent below the rotation axis of said wheel and tire, adapted to straddle strap-like between the outboard-most surfaces of said tire, and thence the extremeties of said second element, adapted symmetrically strap-like against curving surfaces of said tire, overlapped by extremeties of said first element, and the extremeties of said second element terminating short of projecting horizontally beyond the periphery of said tire; two holes through each of said strap elements, said holes being two pairs of co-axial holes substantially at center portions of the overlapping areas of said two strap elements; two flexible link members with depending hook means, connecting through said two pairs of co-axial holes, thereby connecting said two strap elements to form a closed metal loop embracing said wheel and tire, and said link members extending upwards converging to a single lifting connector and pivotally connect thereto by single bolt means through links at or adjacent the extremeties of said link members on respective sides of said connector generally vertically above the rotation axis of said wheel and tire and adjacent the outboard-most surface of said tire, and said lifting connector adapted in its central portion for interfitting engagement with a lifting-force member of an external lifting device; and spacer block means to separate said lifting connector from said tire if necessary to provide clearance between portions of said vehicle and portions of said external lifting device, and if necessary to provide vertical alignment of an external lifting device such as a bumper jack.

* * * * *